United States Patent [19]

Schultheiss

[11] 3,955,612

[45] May 11, 1976

[54] METAL MELTING AND CASTING PROCESS

[76] Inventor: Alfons Schultheiss, Grenzweg 9, 7541 Salmbach, Pforzheim, Germany

[22] Filed: June 19, 1974

[21] Appl. No.: 480,854

[52] U.S. Cl. ..... 164/62; 164/255

[51] Int. Cl.[2] ..... B22D 27/16

[58] Field of Search ..... 164/61, 62, 255

[56] References Cited

UNITED STATES PATENTS

| | | | |
|---|---|---|---|
| 973,483 | 10/1910 | Doehler | 164/62 |
| 1,373,794 | 4/1921 | Burns | 164/255 |
| 2,171,778 | 9/1939 | Yantis | 164/250 |
| 3,692,088 | 9/1972 | Kulig | 164/255 |
| 3,705,615 | 12/1972 | Watts | 164/62 |
| 3,712,364 | 1/1973 | Daniel et al. | 164/255 |
| 3,788,382 | 1/1974 | Daniel et al. | 164/255 |

*Primary Examiner*—Ronald J. Shore
*Attorney, Agent, or Firm*—Joseph A. Geiger

[57] ABSTRACT

A method and apparatus for melting and fine-casting precious metals in which a closed, gas-pressurizable crucible is arranged on top of a molding cell and connected thereto via a valve-controlled tapping passage. The melt is tapped under pressure into an evacuated mold, thereby inhibiting melt evaporation and improving melt flow into the mold branches.

3 Claims, 1 Drawing Figure

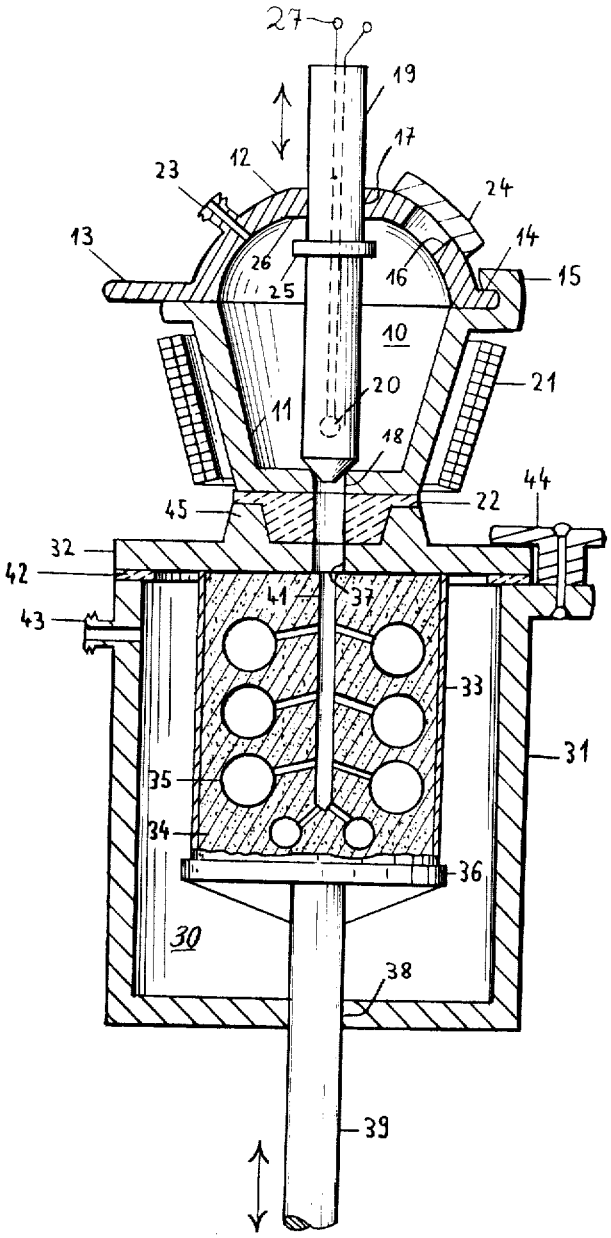
27
19
17
12
23
24
13
14
26
16
15
25
10
21
20
11
18
44
45
22
32
42
41
37
43
33
31
35
34
36
30
38
39

METAL MELTING AND CASTING PROCESS

BACKGROUND OF THE INVENTION

1. Field of the Invention

The present invention relates to melting and casting devices, and in particular to methods and apparatus for melting and casting precious metals in precision molds.

2. Description of the Prior Art

A known problem encountered in connection with fine casting of metals is the influence of the ambient atmosphere on the molten metal. Another problem is that gas pockets may remain entrapped in the mold, tending to inhibit the flow of the melt, especially to remote points of complicated, finely branched molds. An additional limitation to the permissible complexity and cross-sectional configuration of the mold branches is the surface tension of the melt and a tendency of the oxygen of the atmosphere to produce oxidation products with the melted metal or with melt alloy components.

In order to overcome these difficulties, it has already been suggested in the prior art to evacuate the air contained in the mold cavity, or molding cell, and to introduce a rare gas, such as argon, for example, into the crucible. The melt is tapped by opening a valve in the bottom portion of the crucible, whereupon it flows through a sealed connecting channel into the cell. This procedure effectively prevents the formation of oxide films on the casting.

In the case of very finely branched molds, as are encountered, for example, in connection with the casting of jewelry, the above-mentioned problems are particularly severe, representing practical limitations to the complexity of shapes which are castable, because the vacuum inside the molding cell, which latter is pre-heated, tends to induce undesirable evaporation and precipitation of the alloy or of certain alloy components. Obviously, the degree of the difficulties encountered is directly related to the level of the vacuum obtained inside the molding cell. Thus, a tradeoff has to be made between the desire to completely eliminate all gas pockets through the establishment of a high vacuum inside the molding cell and the tendency of partial evaporation and the accompanying alloy precipitation phenomenon.

SUMMARY OF THE INVENTION

It is a primary objective of the present invention to devise an improved method and apparatus by means of which even finely branched shapes can be cast without flaws in metal or metal alloys with the aid of appropriate molds.

In order to attain the above objective, the present invention suggests that the raw metal is melted inside a substantially hermetically closed crucible and that at least during the tapping step the gas contained inside the crucible space be pressurized above atmospheric pressure.

BRIEF DESCRIPTION OF THE DRAWING

Further special features and advantages of the method and apparatus of the invention will become apparent from the description following below, when taken together with the accompanying drawing which illustrates, by way of example, a preferred embodiment of the invention, represented as follows:

The sole FIGURE of the drawing illustrates, in a somewhat simplified axial cross section, a vacuum chamber with a molding cell and a melting crucible arranged above it.

DESCRIPTION OF THE PREFERRED EMBODIMENT

The melting crucible 10 of the preferred embodiment consists of a lower part or tube 11 and an upper part or cover 12. The tub 11 serves as a recipient for the melt, heating and melting of the raw material being accomplished by means of any one of several known melting methods, preferably by electric induction heating. In the embodiment illustrated, the tub 11 of the crucible 10 is surrounded by an induction coil 21. For the sake of clarity of illustration, neither the mounting elements nor the insulation of coil 21 are shown.

The tub 11 of the crucible has a generally tapered cross section with a tapping bore 18 for the melt located at the center of its bottom. The crucible cover 12 is generally hemispherical in shape and includes a radially extending flange portion 14 cooperating with a similar flange portion on the upper rim of tub 11.

The cover 12 can be blocked to the tub 11 of the crucible by means of a flange lock consisting of three substantially regularly spaced upwardly overhanging flange noses 15 on the tub rim and cooperating peripheral recesses (not shown) on the flange portion 14 of the cover 12 for the engagement of the latter under the flange noses 15, when the recesses of flange portion 14 are aligned with the noses 15. Once engaged in this manner, the cover 12 can be rotated around its center axis, whereupon the flange portion 14 becomes clamped under the three flange noses 15. Cover 12 includes a handle extension 13, in order to facilitate the twisting action for clamping and unclamping. This locking possibility of the crucible cover onto the crucible tub is an important improvement offered by the present invention, as will be explained further below in connection with the novel casting method suggested herein.

The crucible cover 12 further includes in its center axis a vertical guide bore 17 inside which is received the upper portion of a tapping rod 19. A filler opening 16 arranged laterally offset from guide bore 17 permits the introduction of the raw metal, which is normally available as a granulate. The filler opening 16 can be closed by means of a filler cover equipped with appropriate clamping means (not shown). Normally, the guide bore 17 engages the upper portion of the tapping rod 19 in a substantially sealing relationship. In addition, the tapping rod 19 may be provided with a sealing collar 25 which is fixedly attached to it at a distance below bore 17 so that, when the tapping rod 19 is lifted, its sealing collar 25 abuts against an inner face 26 surrounding the bore 17 of the cover 12, thereby providing an improved seal at the time of crucible pressurization, during tapping of the melt. Lastly, the cover 12 includes a pressure connection 23 for the introduction of pressurized gas into the crucible, connection 23 being threaded for the attachment of a suitable pressure line (not shown).

The tapping rod 19 extends downwardly along the axis of the crucible 10 and engages with its lower extremity the tapping bore 18, the rod 19 having preferably a tapered end portion for centered seating against bore 18. Thus, the tapping rod 19, while being guided for vertical motion inside bore 17, acts as a valve plunger against the tapping bore 18, keeping the latter normally closed. The tapping rod 19 may be hollow and may have incorporated in it an additional element 20, the electric leads being shown schematically at 27 at the upper end of the rod.

When the melt is to be tapped, the tapping rod 19 is simply raised until its tapered lower end is disengaged from the tapping bore 18, and its sealing ring 25 abuts against the inner face 26 of the crucible cover 12.

The entire crucible assembly 10 including the surrounding induction coil 21, can be lifted upwardly away from the cell and swivelled horizontally, in order to separate the crucible from the mold or molding cell and to swing it back in place, as necessary. Means which are suitable for this procedure are known from the prior art and are therefore not part of this invention.

Surrounding the casting mold or cell is a vacuum chamber 30 consisting again of a container-shaped lower part or vacuum receptacle 31 which is covered by a substantially flat upper part or lid 32 closing the aperture on the upper end of receptacle 31. The lid 32 rests with its inner side against a rim portion of the receptacle 31, with a gasket 42 interposed for sealing purposes. Lid 32 is held against the rim of receptacle 31 by means of two or more clamping brackets 44 which may be in the form of laterally pivotable cam latches.

The lid 32 of the vacuum receptacle 31 has a centrally located inlet bore 37 for the melt. The receptacle 31 itself has an axially aligned guide bore 38 in its bottom portion inside which is received a vertically movable lifting column 39. The latter may be connected with hydraulic lifting means, raising and lowering column 39 with respect to the vacuum receptacle 31. The lifting column 39, reaching into the vacuum chamber 30, carries on its upper end a pressure plate 36 which in turn carries the molding cell. The raised lifting column 39, when biased upwardly, firmly clamps the cell between it and the lid 32 at the upper end of the vacuum chamber.

The cell itself is preferably surrounded by a cylindrical protective casing 33 made of ferric metal. The casing 33 has on its circumference numerous perforations (not shown in the drawing) which are preferably round bores. These perforations facilitate the evacuation of the air from the cavities of the molding cell contained inside the protective casing 33. In the embodiment shown, the casting mold or cell has a central axially extending pouring channel 41 arranged in alignment with the inlet bore 37 in the lid 32 of the vacuum chamber.

The cell 34 can only be put in place or removed from the vacuum chamber 30, after first removing the lid 32. The cell is then placed on top of the pressure plate 36 inside receptacle 31, whereupon the lid 32 is replaced and locked by means of the clamping brackets 44. The lifting column 39 is then hydraulically or pneumatically biased so that the cell 34 is vertically clamped between lid 32 and pressure plate 36, the main pouring channel 41 of the molding cell being in alignment with the inlet opening 37 and the faces surrounding these openings abutting against one another to form a seal.

A special gasket flange 22, preferably circular in outline, may be provided between the bottom of the crucible tub 11 and the lid 32 of the vacuum chamber 30. This gasket flange 22 is preferably centered by means of an upstanding annular projection 45 on the upper side of lid 32. The gasket flange 22 has a central bore linking the tapping bore 18 of the crucible tub 11 with the inlet opening 37 of the vacuum chamber. Together, these bores form a straight vertical tapping passage. Lastly, the vacuum receptacle 31 is also provided with a threaded connection 43, similar to connection 23 of the crucible cover 12, for the attachment of a vacuum line (not shown) through which the vacuum chamber 30 and the molding cell can be evacuated.

Following the placement of a casting cell 34 inside the vacuum chamber 30, placement of the lid 32 onto the vacuum receptacle 31, and clamping of the cell against the latter by means of the lifting column 39, the vacuum chamber 30 can be evacuated by applying suction to its connection 43. Both the advantages and the limitations of such evacuation of the molding cell have been explained earlier.

The central pouring channel 41 of the cell, being in direct communication with the inlet opening 37 and the tapping bore 18 of crucible 10, is hermatically closed against the outside and, as long as the tapping rod 19 is not raised, is also closed against the inside of crucible 10. With the crucible 10 thus connected to the molding cell 34 and the vacuum chamber 30 subjected to a vacuum, the casting process itself can be initiated by lifting the tapping rod 19 from its closed position. However, the present invention further suggests that, during or just prior to this tapping step, a pressurized rare gas be introduced into the crucible 10 through its connection 23. The pressure head thus created inside crucible 10 effectively counteracts previously encountered evaporation tendencies of the melt and of its alloy components, any space created inside the crucible through the discharge of melt into the mold being immediately filled with additional pressurized gas. At the same time, the vacuum established inside the molding cell itself is maintained. Thus, as the melt quickly flows into the pre-heated cell, under the influence of the pressurized gas head inside crucible 10, the melt tends to fill even the finest ramifications of the mold units 35. Any residual air pockets that might still remain inside these ramifications are eliminated and expelled as a result of the increased speed melt penetration and of the pressure behind the melt.

The combination of the vacuum chamber 30 with the pressurization of the melting crucible 10 at the beginning of the tapping step has shown itself to be very effective in practical applications, inasmuch as the mold penetrations obtained have been excellent and an additional advantage of an intimate mixing of the alloy components has been observed. Another advantage afforded by the novel method and apparatus of the invention is the fact that they now permit the establishment of a negative pressure inside the evacuated molding cell which is safely above the negative pressure values at which a risk of spontaneous evaporation of the melt, or precipitation of its alloy components exist.

The present invention is therefore particularly advantageous in connection with its application in the casting of such alloys, where the aforementioned difficulties in connection with precipitation of alloy components are most severe. It is this use of certain alloy components which made it impossible, in the past, to utilize an otherwise desirable high vacuum in the molding cell for optimal melt penetration of the mold. With the novel melting and casting method and apparatus, this no longer presents a problem. Thus, it has been demonstrated that excellent results are obtainable with a negative pressure inside the cell which is still above 0.1 $kg/cm^2$. The pressure applied in this case to the melt inside the crucible ranged between 0.3 and 3.0 $kg/cm^2$ surpressure.

Obviously, the optimal relationship between the level of negative pressure to be established inside the molding cell and the surpressure to be applied to the melt depends in each case on the type and quantities of the alloy components used. Once various optimal combinations have been established through trial and error, and preferably collected in a suitable table, it becomes a simple expedient to obtain the desired results with any particular melt composition.

The use of electrical induction heating for the melting of the raw material granulate has the additional advantage of inducing a mixing action in the melt which is a desirable side effect. However, there are of course other heating methods suitable for use in conjunction with the present invention, such as electrical resistance heating, and others.

It should be understood, of course, that the foregoing disclosure describes only a preferred embodiment of the invention and that it is intended to cover all changes and modifications of this example of the invention which fall within the scope of the appended claims.

I claim:

1. A method of producing finely branched casting of metal and metal alloys, such as jewelry castings of precious metal alloys, for example, the method comprising the steps of:

arranging a hermetically closable crucible above a mold enclosed within a hermetically closable receptacle, with a valve-closable tapping channel leading from the bottom of the crucible to the mold sprue;

applying to the receptacle a negative pressure, thereby evacuating from the mold cavity a substantial portion of the gas contained therein;

melting in the crucible a charge of casting metal, while pressurizing the closed crucible with a gas; and tapping the melted charge from the pressurized crucible into the partially evacuated mold, by opening the valve of the tapping channel.

2. A melting and casting method as defined in claim 1, wherein the step of pressurizing the crucible with a gas involves the use of an inert gas.

3. A melting and casting method as defined in claim 2, wherein the step of melting involves the use of inductive heat, generated by an induction coil surrounding the hermetically closed crucible.

* * * * *